US007036410B2

(12) United States Patent
Reinders

(10) Patent No.: US 7,036,410 B2
(45) Date of Patent: May 2, 2006

(54) TRANSVERSELY CUTTING AND CONVEYING A WEB

(75) Inventor: Peter Reinders, Ochtrup (DE)

(73) Assignee: Schmale-Holding GmbH & Co., Ochtrup (DE)

( * ) Notice: Subject to any disclaimer, the term of this patent is extended or adjusted under 35 U.S.C. 154(b) by 2 days.

(21) Appl. No.: 10/801,882

(22) Filed: Mar. 16, 2004

(65) Prior Publication Data

US 2004/0182210 A1 Sep. 23, 2004

(30) Foreign Application Priority Data

Mar. 19, 2003 (DE) ..... 103 12 328

(51) Int. Cl.
*B26D 7/06* (2006.01)
*B26D 5/20* (2006.01)
*B65H 29/70* (2006.01)

(52) U.S. Cl. ..... 83/23; 83/206; 83/277; 271/188

(58) Field of Classification Search ..... 83/23, 83/153, 155, 206, 207, 262, 236, 277, 282, 83/109, 151; 493/369, 356; 271/188
See application file for complete search history.

(56) References Cited

U.S. PATENT DOCUMENTS 3,599,521 A * 8/1971 Lee ..... 83/210
3,673,905 A * 7/1972 Kono ..... 83/175
3,722,435 A * 3/1973 Elsas ..... 112/470.05
3,831,472 A * 8/1974 Sasaki ..... 83/92
3,882,744 A * 5/1975 McCarroll ..... 83/262
4,271,767 A * 6/1981 Burton et al. ..... 112/2
4,519,595 A * 5/1985 Adachi ..... 270/30.11
5,072,637 A * 12/1991 Reichental et al. ..... 83/23
5,139,424 A * 8/1992 Yli-Urpo ..... 433/201.1
5,375,493 A * 12/1994 Focke et al. ..... 83/94
5,445,053 A * 8/1995 Kallner ..... 83/23
5,772,838 A * 6/1998 Zablotny et al. ..... 156/512
6,230,596 B1 * 5/2001 Reinders ..... 83/27
6,336,406 B1 * 1/2002 Wakabayashi et al. ..... 101/483
6,418,825 B1 * 7/2002 Hartmann ..... 83/110
6,460,440 B1 * 10/2002 Tsune ..... 83/153
6,601,489 B1 8/2003 Reinders
2002/0026861 A1 * 3/2002 Reinders ..... 83/13

* cited by examiner

*Primary Examiner*—Kenneth E. Peterson
*Assistant Examiner*—Isaac N. Hamilton
(74) *Attorney, Agent, or Firm*—Andrew Wilford

(57) ABSTRACT

A gripper pulls a web off a supply downstream through upstream and downstream clamps. The upstream clamp is closed on the web and a piece is cut off its end. Then the gripper is moved back upstream to form the cut-off piece into a dependent loop while the lower part of the downstream clamp is held down and back out of the way so it does not contact the dependent loop. Once the gripper has moved upstream passed the lowered downstream clamp part, it is raised and advanced downstream to press the web against the upper downstream clamp part. Then both clamps are displaced transversely to move the web as a dependent loop transversely away.

10 Claims, 3 Drawing Sheets

TRANSVERSELY CUTTING AND CONVEYING A WEB

FIELD OF THE INVENTION

The present invention relates to a system for transversely cutting an end off a longitudinally extending web and for transversely conveying away the cut-off piece. More particularly this invention concerns a method and apparatus for transversely cutting an end off a longitudinally extending web and for transversely conveying away the cut-off piece.

BACKGROUND OF THE INVENTION

In the manufacture of bed linens, towels, and the like, it is standard to start with a large roll of the necessary fabric web. A clamp grips the transversely extending free end of the fabric web and pulls a section of it longitudinally from the roll. This section is then gripped in another clamp at a distance from its free end and the web is transversely severed just upstream of this other clamp, leaving the section clamped at both ends and extending in a generally straight longitudinal path between the two clamps that can then be transported transversely to a second treatment station to which it is handed off. At this transversely offset second station the ends can be hemmed or otherwise finish, or the workpiece can be subjected to any of an assortment of treatments.

The problem with this type of system is that the equipment that cuts the workpiece off the roll and transports it transversely to the treatment station takes up a great deal of space. The transport path to the second station must be as wide as the workpiece is long, so that if the second station is not immediately adjacent the first cutting station, a great deal of floor space is occupied by the conveyor.

OBJECTS OF THE INVENTION

It is therefore an object of the present invention to provide an improved cutting and transporting system for a web workpiece.

Another object is the provision of such an improved cutting and transporting system for a web workpiece which overcomes the above-given disadvantages, that is which accurately and surely cuts the web, but that takes up relatively little floor space in transporting it transversely away from the cutting location.

SUMMARY OF THE INVENTION

A piece is cut off an elongated web and transported the transversely from the web by an apparatus having a gripper closable on the web and displaceable longitudinally of the web along a longitudinal path between an advanced position close to a stationary supply of the web and a retracted position spaced longitudinally from the supply, upper and lower clamp parts extending transversely across and vertically flanking the path, and upper and lower longitudinally generally nondisplaceable upstream clamp parts extending transversely across and vertically flanking the path between the downstream clamp parts and the supply. With the upper clamp parts spaced vertically from the lower clamp parts, the gripper is displaced upstream toward the supply between the clamp parts, then closed on the web, and reversed to pull the web downstream along the path between the clamp parts so that a length of the web extends downstream along the path from the supply between the clamp parts. The upstream clamp parts are closed on the web to clamp it, the web is cut transversely through between the supply and the upstream clamp parts to create a separate downstream piece held between the gripper and the upstream clamp parts, the gripper while still closed on the piece is shifted back downstream such that the piece forms a dependent loop between the gripper and the upstream clamp parts until the gripper is immediately downstream of the downstream clamp parts and the lower downstream clamp part is displaced simultaneously upward and upstream toward the upper downstream clamp part to clamp the web between the upper and lower downstream clamp parts when the gripper is immediately downstream of the downstream clamp parts. Finally, the web is released from the gripper and the piece is transported as a dependent loop horizontally transversely of the direction with the clamp parts without significantly longitudinally displacing the clamp parts.

Thus with this system, after the piece has been pulled straight out, the gripper is backed up to form it into a dependent loop that, while relatively tall, takes up very little floor space. This loop is then what is transported transversely away The longitudinal direction according to the invention is horizontal. The lower downstream clamp part is displaced in between an upper position pressing the web against the upper downstream clamp part and a lower position spaced upstream and below the upper downstream clamp part. This lower downstream clamp part moves in a straight or curved line between its upper and lower positions, in both cases remaining wholly out of contact with the web until the time it actually presses it against the downstream upper clamp part.

The web in accordance with the invention is supported on a flat table or surface between the supply and the upstream clamp part.

The upper clamp parts include respective transversely displaceable elements, e.g. lower stretches of conveyor belts. The piece is transported horizontally transversely of the direction by transverse shifting of the transversely displaceable elements relative to the respective lower clamp parts, by sliding the web on the lower clamp parts. During displacement of the gripper upstream of the downstream clamp parts, the upper clamp parts are spaced sufficiently above the lower clamp parts that the gripper can pass between them.

BRIEF DESCRIPTION OF THE DRAWING

The above and other objects, features, and advantages will become more readily apparent from the following description, reference being made to the accompanying drawing in which.

SPECIFIC DESCRIPTION

Figure 5:
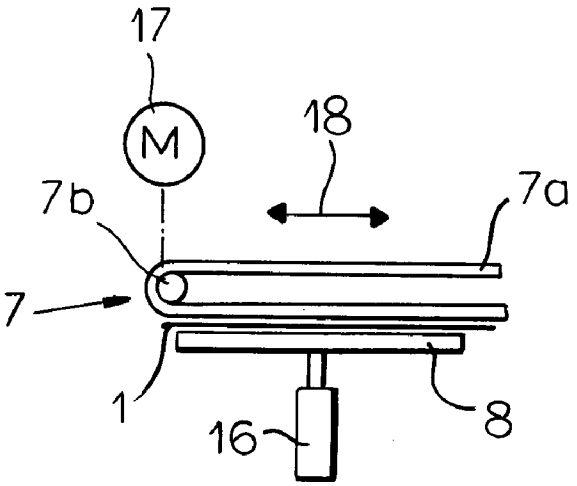
FIG. 5 is an end view taken in the direction of arrow V of FIG. 2.

As seen in FIGS. 1 through 5, a flexible web 1 is wound up on a supply roll 14 and can be pulled therefrom in a horizontal longitudinal direction 2 by a device 3 reciprocal in this direction and having a gripper 4 that can clamp the free end edge of the web 1, here extending perpendicular to the plane of the views of FIGS. 1–4 in a direction 18 (FIG. 5). The gripper 4 can move all the way upstream (to the right in FIGS. 1–4) through a transverse conveyor/clamp device 6 having upstream and downstream upper clamp parts 7 and 10. FIG. 5 shows how the upper upstream clamp part 7, which is identical to the upper downstream clamp part 10, is formed as a belt 7*a* reeved over a pulley 7*b* and driven by a motor 17 to displace its horizontal lower stretch in the horizontal transverse direction 18 perpendicular to the longitudinal direction 2. Underneath the upper upstream clamp part 7 is a lower upstream holder bar or part 8 vertically displaceable in a direction 9 by an actuator 16, here a pneumatic cylinder 16, toward and away from the respective upper part 7. A lower downstream holder bar or part 11 can move along an angled path 12 on guides 13 between a lower position (FIG. 2) spaced from and an upper position (FIGS. 3 and 4) bearing against the upper downstream clamp part 10. The guides 13 can be straight or arcuate but extend generally at an acute angle to the horizontal direction 2. The bar 11 can be moved by another pneumatic actuator like the actuator 16 and can have shoes or guides slidable on rods forming the guides 13, or these guides 13 can be formed as racks meshing with gears carried in the ends of a rod journaled in the bar and serving to keep it square as it moves along the guides 13.

A cutter 5 is provided just upstream of the upstream clamp parts 7. A table 15 extends just underneath the plane or path of the web 1 from the supply 4 to immediately upstream of the cutter 5. A controller 19 is connected to the device 3, gripper 4, actuator 16, part 11, cutter 5, and motor 17.

Figure 1:
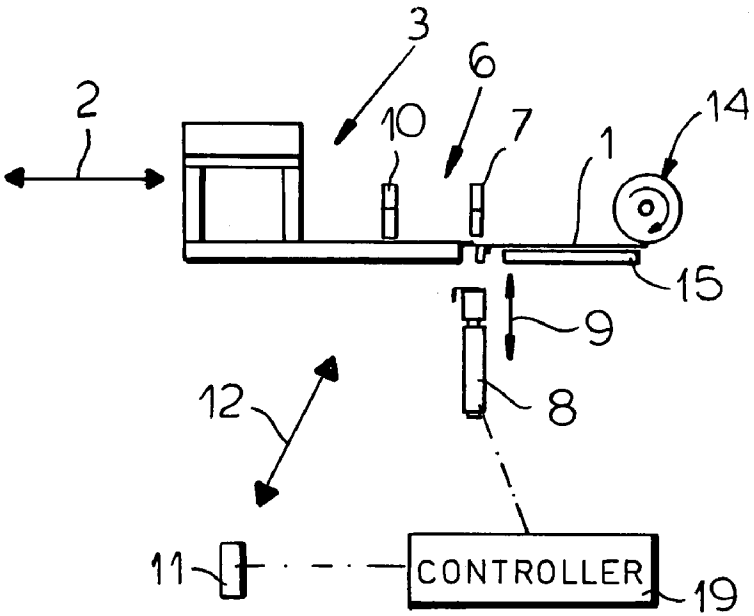
FIG. 1 is a schematic side view illustrating the apparatus of this invention in a first operational step.
Figure 2:
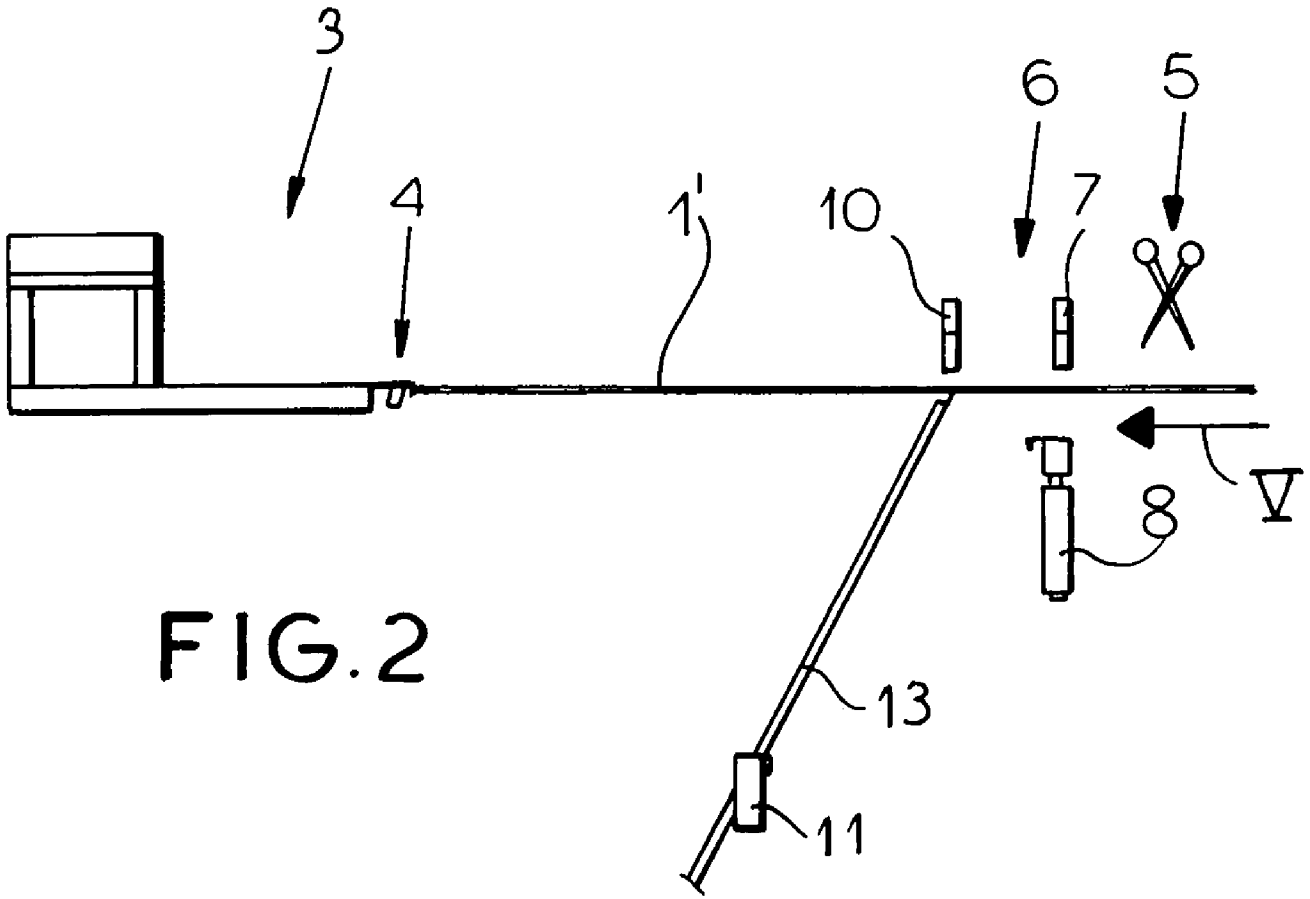
FIGS. 2 through 4 are views like FIG. 1 but showing succeeding operational steps.
Figure 4:
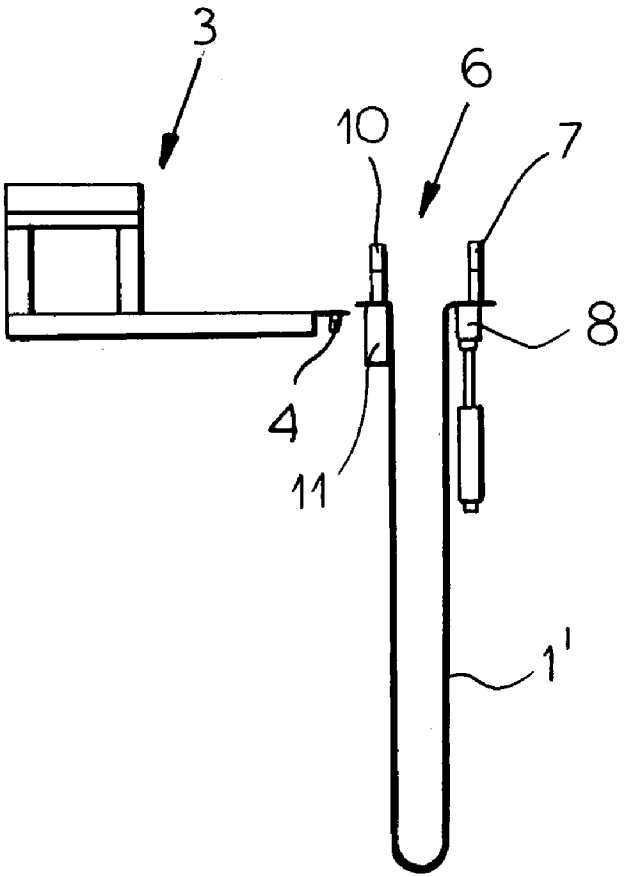
Figure 3:
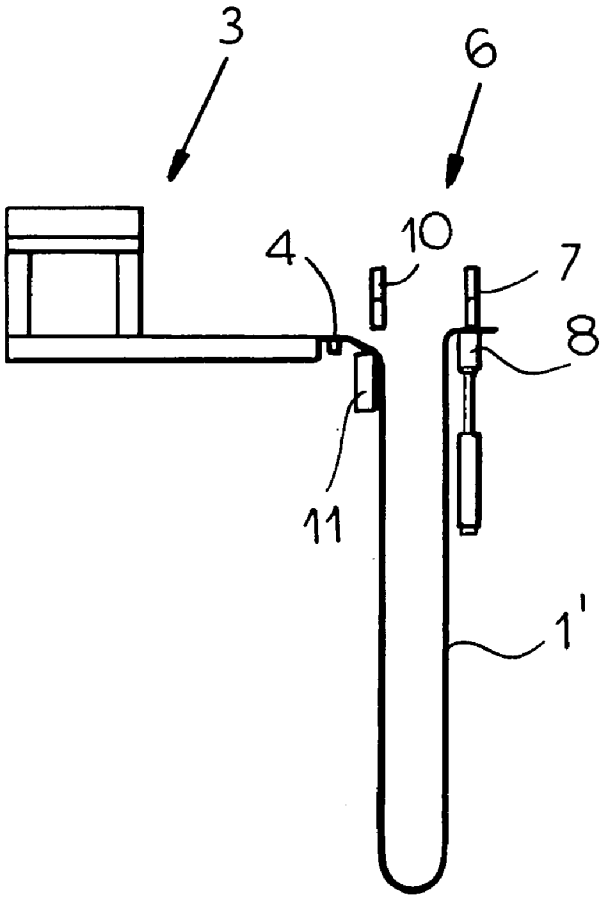

The system described above operates as follows:

To start with the lower clamp parts 8 and 11 are spaced well below the plane or path of movement of the gripper 4 and the parts 7 and 10 are slightly above this plane. Then the device 3 and gripper 4 are moved upstream, with the gripper 4 reaching upstream roughly to the cutter 5 where it grabs the free end of the web 1 (FIG. 1). Thereafter the device 3 and gripper 4 are moved downstream to the position of FIG. 2 so that a downstream end section 1' of the web 1 is pulled off the supply 14. This section extends in a horizontal plane parallel to the direction 2 underneath the upper clamp parts 7 and 10 and above the lower clamp parts 8 and 11.

At this point the lower upstream holding bar 8 is moved upward in the direction 9 to clamp the web 1 against the upper upstream holding part 7 and the cutter is actuated to cut the downstream end section 1' from the web 1.

As soon as the clamp parts 7 and 8 are gripping the upstream end of the piece 1', the device 3 and gripper 4 are moved back upstream so that the piece 1' starts to form a dependent loop downstream of the parts 7 and 8. At roughly the same time the downstream lower holding bar 11 is moved simultaneously in the direction 12 upstream and upward until it assumes first the position of FIG. 3 and then of FIG. 4, holding a downstream end of the piece 1' between the parts 10 and 11. As a result of the angled path 12 of movement, the part 11 never contacts the piece 1' until about when it clamps it to the upper part 10 so that it cannot mar or damage it.

This leaves the piece hanging as a vertically long and horizontally short loop between the upstream parts 7 and 8 and downstream parts 10 and 11. At this time the motors 17 of the is upper parts 7 and 10 are operated to move this dependent loop off transversely. Once the piece 1' is out of the way and handed off to the next production step, the lower parts 8 and 11 are moved back down to their FIG. 2 rest positions and the device 3 and gripper 4 can move back upstream to grip the free end of the web 1 and restart the cycle.

I claim:

1. A method of cutting a piece off an elongated web and transporting the cut-off piece transversely from the web using an apparatus comprising:

a gripper closable on the web and displaceable longitudinally of the web along a longitudinal path between an advanced position close to a stationary supply of the web and a retracted position spaced longitudinally from the supply;

upper and lower downstream clamp parts extending transversely across and vertically flanking the path; and upper and lower longitudinally generally nondisplaceable upstream clamp parts extending transversely across and vertically flanking the path between the downstream clamp parts and the supply;

the method comprising the steps of sequentially;

a) with the upper clamp parts spaced vertically from the lower clamp parts, displacing the gripper upstream in a longitudinal direction toward the supply between the clamp parts, closing the gripper on the web, and pulling the web downstream along the path between the clamp parts so that a length of the web extends downstream along the path from the supply between the clamp parts, and closing the upstream clamp parts on the web to clamp it;

b) transversely through cutting the web between the supply and the upstream clamp parts to create a separate downstream piece held between the gripper and the upstream clamp parts;

c) displacing the gripper while still closed on the piece back upstream such that the piece forms a dependent loop between the gripper and the upstream clamp parts until the gripper is immediately downstream of the downstream clamp parts and displacing the lower downstream clamp part simultaneously upward and upstream toward the upper downstream clamp part to clamp the web between the upper and lower downstream clamp parts when the gripper is immediately downstream of the downstream clamp parts;

d) releasing the web from the gripper; and e) transporting the piece as a dependent loop horizontally transversely of the direction with the clamp parts without significantly longitudinally displacing the clamp parts.

2. The method defined in claim 1 wherein the longitudinal direction is horizontal.

3. The method defined in claim 1 wherein in step the lower downstream clamp part is displaced in step c) between an upper position pressing the web against the upper downstream clamp part and a lower position spaced upstream and below the upper downstream clamp part.

4. The method defined in claim 3 wherein the lower downstream clamp part moves in a straight line between its upper and lower positions.

5. The method defined in claim 3 wherein the lower clamp part moves in step c) in an arc between its upper and lower positions.

6. The method defined in claim 1, further comprising supporting the web on a flat surface between the supply and the upstream clamp part.

7. The method defined in claim 1 wherein the upper clamp parts include respective transversely displaceable elements, the piece being transported horizontally transversely of the direction by transverse shifting of the transversely displaceable elements relative to the respective lower clamp parts.

8. The method defined in claim 7 wherein the upper clamp parts are vertically substantially fixed.

9. The method defined in claim 8 wherein during step c) the piece slides on the lower clamp parts.

10. The method defined in claim 1 wherein, in step a) during displacement of the gripper upstream of the downstream clamp parts, the upper clamp parts are spaced sufficiently above the lower clamp parts that the gripper can pass between them.

* * * * *